US007661677B2

(12) United States Patent
Friedman

(10) Patent No.: US 7,661,677 B2
(45) Date of Patent: Feb. 16, 2010

(54) HARD PASS CRAPS WAGER

(75) Inventor: Stacy Friedman, Beaverton, OR (US)

(73) Assignee: Olympian Gaming LLC, Beaverton, OR (US)

( * ) Notice: Subject to any disclaimer, the term of this patent is extended or adjusted under 35 U.S.C. 154(b) by 203 days.

(21) Appl. No.: 11/468,779

(22) Filed: Aug. 31, 2006

(65) Prior Publication Data

US 2006/0290050 A1 Dec. 28, 2006

Related U.S. Application Data

(63) Continuation-in-part of application No. 11/064,444, filed on Feb. 23, 2005, now Pat. No. 7,377,513.

(60) Provisional application No. 60/713,786, filed on Sep. 1, 2005, provisional application No. 60/720,697, filed on Sep. 27, 2005, provisional application No. 60/547,904, filed on Feb. 25, 2004.

(51) Int. Cl.
*A63F 3/00* (2006.01)

(52) U.S. Cl. ..... 273/274; 273/146

(58) Field of Classification Search ..... 273/274, 273/146
See application file for complete search history.

(56) References Cited

U.S. PATENT DOCUMENTS

| | | | | |
|---|---|---|---|---|
| 5,931,471 | A * | 8/1999 | Bonito | 273/274 |
| 6,761,353 | B2 * | 7/2004 | Berman et al. | 273/143 R |
| 6,802,508 | B2 * | 10/2004 | Moody | 273/146 |
| 7,229,352 | B2 * | 6/2007 | Bonito | 463/22 |
| 2008/0061505 | A1 * | 3/2008 | Snow | 273/274 |

* cited by examiner

*Primary Examiner*—William M Pierce
(74) *Attorney, Agent, or Firm*—Muskin & Cusick LLC

(57) ABSTRACT

A wager for casino craps which allows a player to win when a come out shooter makes a hard point (e.g. rolls 2/2 or 3/3 or 4/4 or 5/5), and then the shooter makes the point (before the shooter rolls a seven) with the same hard point (e.g. 2/2 or 3/3 or 4/4 or 5/5). If the shooter does not roll a hard point (1/1 and 6/6 are considered 'craps' and are not points) or the shooter rolls a hard point on the come out roll but does not make the same hard point before rolling a seven (or makes the point without rolling the hard point), then the player loses the wager.

4 Claims, 4 Drawing Sheets

HARD PASS CRAPS WAGER

CROSS REFERENCE TO RELATED APPLICATIONS

This application claims benefit to provisional application No. 60/713,786, filed Sep. 1, 2005, which is incorporated by reference herein in its entirety. This application also claims benefit to provisional application No. 60/720,697, filed Sep. 27, 2005, which is incorporated by reference herein in its entirety. This application is also a continuation in part application of application Ser. No. 11/064,444, filed Feb. 23, 2005, now U.S. Pat. No. 7,377,513, which claims benefit to provisional application No. 60/547,904, filed Feb. 25, 2004, both of which are incorporated by reference herein in their entireties.

BACKGROUND OF THE INVENTION

1. Field of the Invention

The present inventive concept relates to a casino table game, and more particularly, to a variation of casino craps which includes a new wager.

2. Description of the Related Art

Although games involving dice are extremely popular in non-gaming environments, only craps has been successful in a gaming environment. The game of craps is offered in nearly all casinos. Craps involves two six sided dice which are rolled two or more times by a designated player (the "shooter"). The fundamental bet in craps is known as the "pass" bet. The pass line bet is lost on a first roll ("come out") of 2, 3, or 12. Each pass bet wagerer is paid even money on a come out roll of 7 or 11. In either case, the pass bet is resolved and a new wager must begin. Should the shooter's come out roll be a 4, 5, 6, 8, 9, or 10, that number is identified as the "point." Thereafter, the shooter continues to roll the dice until the point is repeated or a seven is rolled, whichever occurs first. If the point is repeated ("making the point"), each pass wagerer is paid even money on their pass bets and a new game begins with the same shooter. If a seven is rolled ("seven-out") prior to making the point, each pass bet wagerer loses their pass bet and the shooter must relinquish the dice to another participant. Craps also includes a host of additional wager opportunities related to each roll of the dice. For example, players may wager that any number will be rolled on a subsequent roll, bet that the value of each die will match (i.e snake eyes), and so on.

In craps, a "hard way" or "hard" number is one of 4, 6, 8, or 10, rolled with both dice showing the same number. The dice show a hard 4 if each die displays a 2. The dice show a hard 6 if each die displays a 3. The dice show a hard 8 if each die displays a 4. The dice show a hard 10 if each die displays a 5.

Also in craps, a "proposition" bet is any of the rolls displayed in the center of the casino craps layout, usually with high payouts and correspondingly high house advantages. Examples of proposition bets include a single-roll bet on the number 12, the single-roll "Any-7" bet, and the single-roll "Any Craps" bet. In addition, there are four "hard way" wagers based on the proposition that the shooter will roll a given hard number before either the non-hard version of that number or a seven appears.

Several other dice games have been attempted in casinos, but without great, or even moderate, success. One such game is known as "Chuck-a-Luck." Chuck-a-Luck is a game involving a single roll of three six sided dice having associated payouts related to one, two, or three of the dice faces showing a selected number from one to six. Another dice game is known as "Under and Over 7. " Under and Over 7 allows players to wager whether the sum of two dice will be less than, more than or equal to seven.

Casino craps is the only significantly successful casino dice game. The game of craps is exciting, but traditionally has payouts only as high as 31-1. Moreover, the wagers that pay the highest multiples also tend to have the worst odds for the player.

A side wager for craps known as the Fire Bet (U.S. Pat. No. 6,655,689) has payouts as high as 2500-1, although that wager has up to a 20% house advantage. Furthermore, based on the rules, one Fire Bet can be made per shooter. Since each shooter rolls an average of 8.5 rolls before relinquishing the dice, many fewer Fire Bets can be made per hour, thereby decreasing the casino's revenue potential when compared to other, more frequently-made wagers.

Therefore, what is needed, is a craps wager that overcomes the limitations in the prior art by providing a wager for casino craps with a high payout, a fast rate of resolution, and a reasonable house advantage.

SUMMARY OF THE INVENTION

It is an aspect of the present invention to provide exciting variations of craps that can be played in casinos.

The above aspects can be obtained by a method that includes (a) receiving a hard pass wager; (b) allowing a shooter to initially roll a pair of dice resulting in a come out roll; (c) determining if the come out roll is not a hard 4, hard 6, hard 8, or hard 10, and if the come out roll is not a hard 4, hard 6, hard 8, or hard 10 then the hard pass wager loses and is collected by the house; and (d) otherwise, continuing to receive rolls by the shooter until the shooter rolls a last roll which is either a 7 or equals the come out roll, wherein if the last roll is hard and equals the come out roll, the hard pass wager wins and is paid a first amount by the house, otherwise the hard pass wager loses and is collected by the house.

The above aspects can also be obtained by a method that includes (a) receiving a wager that a proposition will happen; (b) generating a first random outcome; (c) determining if the first random outcome satisfies the proposition, and if so, then paying off the wager at a first multiplier and the method is completed; (d) determining if the first random outcome satisfies a losing condition, and if so, the wager loses and the method is completed; and (e) continuing to generate further outcomes until either: 1) the losing condition occurs, wherein the wager loses and the method is completed, or 2) the proposition occurs, wherein the wager is paid at a second payoff multiplier, the second payoff multiplier is lower than the first payoff multiplier and the method is completed.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
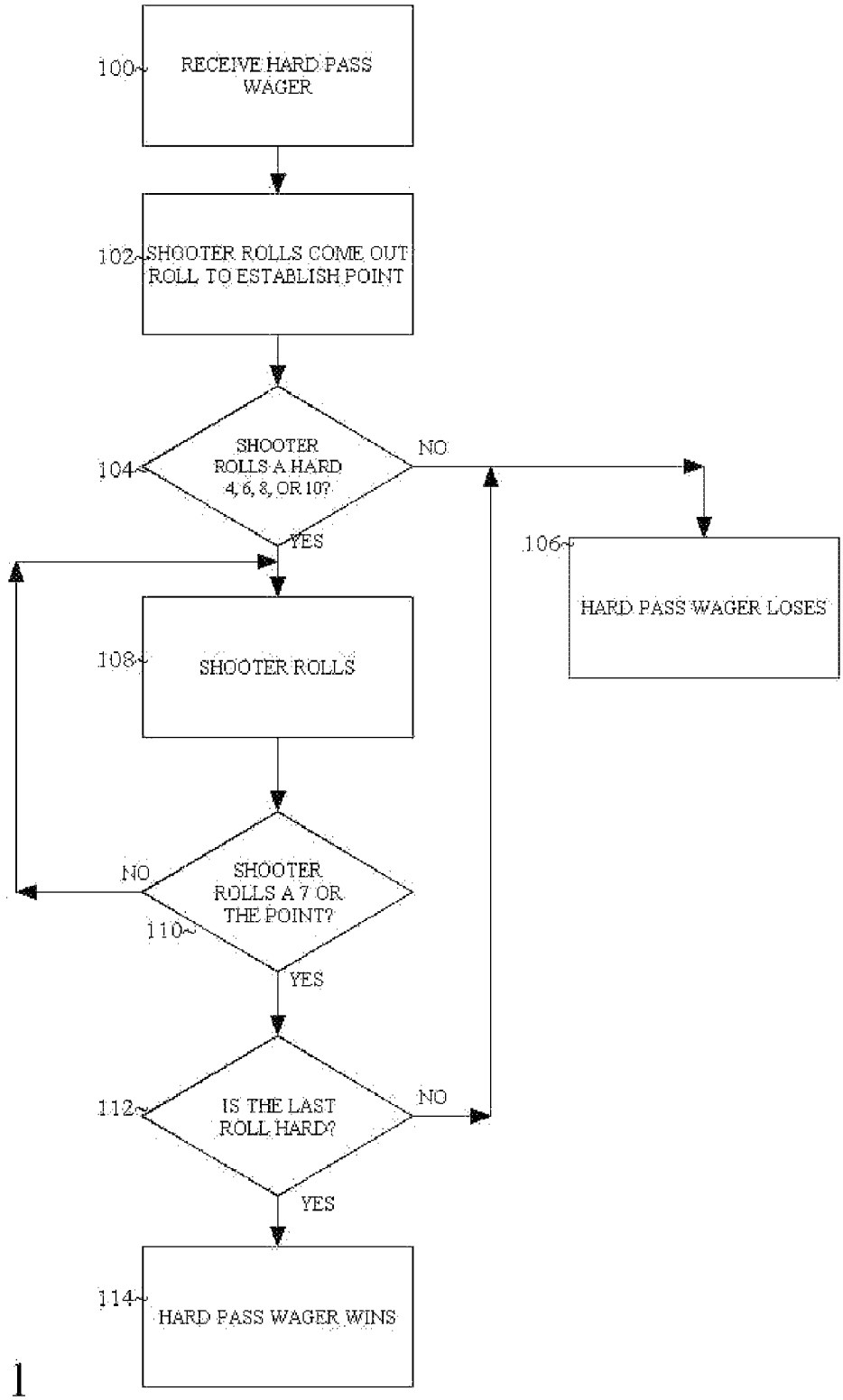
FIG. 1 is a flowchart illustrating an exemplary method of implementing a craps wager, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer to player(s) a new and exciting wager that can appear on a craps table. Information (including standard definitions) about the game of craps can be found in "Scarne's New Complete Guide to Gambling," by John Scarne, 1986, ISBN 0-671-21734-8, which is incorporated by reference herein in its entirety. The present general inventive concept can be applied to any known variation of craps, such as the standard Las Vegas variation which is commonly played in casinos.

The "hardway pass" or "hard pass" wager is a wager typically made at the same time as the come out roll. If the shooter establishes a point with a hard way roll and subsequently wins the point also with the appropriate hard way roll, the hard pass bet wins. If the shooter fails to establish a point, fails to establish a point with a hard way roll, fails to make his point, or fails to make his point with a hard way roll, the hard pass bet loses. A hardway roll (or hard roll) is a roll of two dice wherein each die is equal (e.g. "doubles.")

There are four specific ways the hard pass bet can be won. If the shooter rolls a hard 4 on the come out roll and subsequently wins his point with another roll of hard 4, the Hard Pass bet is won. The bet similarly wins for hard points of 6, 8, and 10. In all other cases, the Hard Pass bet loses.

With such a low frequency of winning, the payout for the Hard Pass bet can be quite high. In fact, a payout of 80-for-1 results in a house advantage of 10.21%, very comparable to many existing proposition bets as well as the existing hard way bets, but with a significantly higher payback. Payouts in the range 75-for-1 up to 85-for-1 may also be attractive to the house. Table I lists payouts and corresponding house advantages for the Hard Pass wager:

TABLE I

| Payout (N-for-1) | House Advantage |
|---|---|
| 75 | 15.82% |
| 76 | 14.70% |
| 77 | 13.58% |
| 78 | 12.46% |
| 79 | 11.34% |
| 80 | 10.21% |
| 81 | 9.09% |
| 82 | 7.97% |
| 83 | 6.85% |
| 84 | 5.72% |
| 85 | 4.60% |

It should be noted that, while most casinos phrase their proposition wager awards as "N-for-1" some other casinos phrase the same wagers as "N-To-1". The difference between "N-For-1" and "N-To-1" is this: a payout of N-For-1 is equivalent to a payout of (N-1)-To-1. In Table 1, the entry for 81-For-1 could also be phrased as "80-To-1". It is likely that casino operators will favor the payouts 80-For-1, 80-To-1, 75-For-1, and 75-To-1, simply due to the relative ease of paying out these wagers. They may also favor 85-For-1 and 85-To-1.

The area on the layout for making the hard pass wager can be located in the center proposition area, and that a player who desires to make the hard pass wager can verbally indicate this desire to the dealer and toss in the desired wager. This action is similar to any other proposition wager. Alternatively, it is envisioned that the hard pass wagers may be placed on a small strip to be added above the Pass Line on the craps layout. If the wager does not lose on the come out roll, the dealer's puck will indicate the point that is required to win the Hard Pass wager (if it is rolled as a hard way).

FIG. 1 is a flowchart illustrating an exemplary method of implementing a craps wager, according to an embodiment.

The method can start with operation 100, wherein the house receives a hard pass wager. This can be done by the player (either the shooter or any other players at the craps table) placing chips to wager in a betting area marked "hard pass wager" or other appropriate marking.

From operation 100, the method can proceed to operation 102, wherein the shooter makes his or her first roll and rolls a pair of dice in order to establish the point. According to standard rules of craps, if the shooter rolls a 2, 3, or 12, (these rolls are considered "craps") any pass bets (bets placed on the pass line) lose, and the craps round is over. If the shooter rolls a 7 or 11, the pass bets win, and the craps round is over. Any other roll (4-6 or 8-10), is considered the "point" and the pass bets are still live pending further roll(s) of the dice. When the point is established, an indicator can be placed on the table to indicate whether the point was made in a hardway. For example, if a point of 6 is made by 3/3, then a puck (or other indicator) can be placed on a special area of the table to indicate a hard point, whereas if a point of 6 is made by 2/4, then the indicator will not be placed on the area to indicate a hard point. Alternatively, two areas can be used, one for a hard point, one for a non-hard (or soft or easy-way) point, and when each point is established an indicator can be placed on the respective area depending on whether the come-out roll was hard or soft.

After the shooter has rolled the come out roll in operation 102 , the method can proceed to operation 104, which determines whether the shooter (in operation 102) rolled a hard 4, hard 6, hard 8, or hard 10 on the pair of dice. These are the only possible points (out of 4-6 and 8-10) which can be rolled "hard," that is, each die in the pair has an identical outcome. If the come out roll is not a hard 4, hard 6, hard 8, hard 10, then the method proceeds to operation 106, wherein the hard pass wagers lose. Any pass wagers are still resolved as known in the art based on the come out roll or future rolls.

From operation 104, the method proceeds to operation 108, wherein the shooter rolls the dice again.

From operation 108, the method can proceed to operation 110, which determines whether the shooter rolled a seven or the point (established in operation 102). If the shooter did not roll a seven or the point, then the pass wagers and the hard pass wagers are still live, and the method returns to operation 108.

If the determination in operation 108 determines that the shooter rolled a seven or the point, then no further rolls are needed to resolve both the pass wagers and the hard pass wagers. If the shooter rolled a seven, then the pass wagers lose (this is standard in craps). If the shooter rolled the point, then the pass wagers win (this is standard in craps). A shooter rolled the point (without regard whether it is hard or not) if the last roll equals the come out roll (a total of the come out roll dice equals a total of the last roll dice), for example, the come out roll was a 4/6 and a subsequent roll is 5/5, then the shooter has made the point. The shooter has also made the point if the come out roll was, for example, 5/5 and a subsequent roll is 5/5. The method proceeds to operation 112, which determines if the last roll was hard, that is, whether each of the die in the pair of dice has an identical result (this is also known as rolling "doubles").

If the determination in operation 112 determines that the last roll was not hard, then the player either rolled a 7 (the pass wager loses) or made the point the "easy way" (not hard, two unequal dies) and the pass wager wins, but nevertheless the method proceeds to operation 106, wherein the hard pass wagers lose.

If the determination in operation 112 determines that the last roll was hard, then the method proceeds to operation 114, wherein the hard pass wager wins, and thus all bets placed on the hard pass wager in operation 100 are paid accordingly. If the hard pass wager wins, then the last roll (that wins the hard pass wager) must match the come out roll (e.g. it isn't enough that the total of each roll equals, the actual indicia on the dice must match to win the hard pass wager).

An example of the method illustrated in FIG. 1 is as follows: A hard pass bet is made. The shooter then rolls a 7 on the come out (first) roll. The hard pass bet loses.

A further example is as follows: A hard pass bet is made. The shooter rolls a 5 on the come out roll. The hard pass bet loses (because the come out roll was not a hard point, e.g., hard 4, hard 6, hard 8, or hard 10).

A further example is as follows: A hard pass bet is made. The shooter rolls a 2/4 on the come out roll for a total of six. The hard pass bet loses (because the come out roll was not hard).

A further example is as follows: A hard pass bet is made. The shooter rolls a 3/3 on the come out roll for a total of six. The shooter has established a hard point of six. The shooter then rolls a second time and rolls a 2/3 for a total of five. Since the shooter has not rolled a 7 (which would cause the pass and hard pass bets to lose), the shooter then rolls a third time and rolls a 2/4 for a total of six. The shooter has made the point (six) and thus the pass wagers win. But the shooter has not made the point by rolling a hard roll, thus the hard pass wagers lose.

A further example is as follows: A hard pass bet is made. The shooter rolls a 3/3 on the come out roll for a total of six. The shooter has established a hard point of six. The shooter then rolls a second time and rolls a 2/3 for a total of five. Since the shooter has not rolled a 7 (which would cause the pass and hard pass bets to lose), the shooter then rolls a third time and rolls a 3/3 for a total of six. The shooter has made the point (six) and thus the pass wagers win. The shooter has made the point by rolling a hard roll, thus the hard pass wagers win as well.

Finally, it is noted that the pass wager may only be made on the shooter's come out roll, but a come wager may be made on any other (non-come out roll). Since the Hard Pass wager also may only be made on the shooter's come out roll, there is an obvious analog in what is called the Hard Come wager. The Hard Come wager is won or lost in exactly the same circumstances as the Hard Pass wager, and with the same payouts, with the exceptions that (1) it may only be made while the shooter is not making a come out roll, and (2) the next roll, not the shooter's come out roll, will determine whether the wager loses or continues on to possibly win.

It is envisioned that the area for making Hard Come wagers will be located on a small area above the Come box, and that the dealers will relocate bets following a hard way roll to either inside or behind the box for the appropriate number, as is typical with standard Come wagers, and will also mark the Hard Come wagers with an indicating lammer or other marker.

In a further embodiment, a special bonus can be awarded if the player wins the hard pass on the first try (e.g. the shooter makes the hard point on the first roll after the come out roll). Of course, making the hard point immediately is more unlikely than just winning the hard pass wager at any point in time (as illustrated in FIG. 1).

Figure 2:
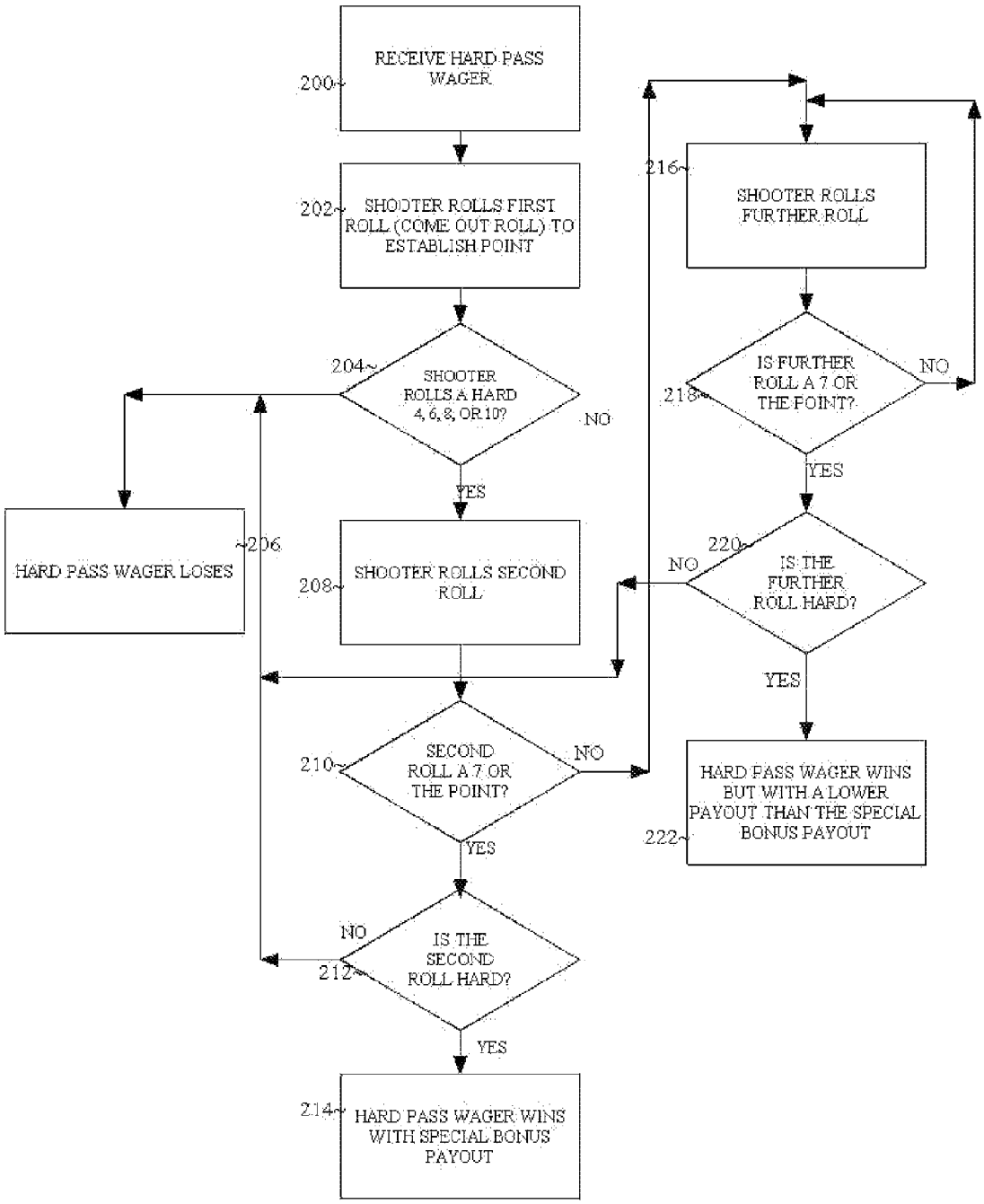
FIG. 2 is a flowchart illustrating an exemplary method of awarding a further bonus for the craps wager, according to an embodiment.

FIG. 2 is a flowchart illustrating an exemplary method of awarding a further bonus for the craps wager, according to an embodiment.

FIG. 2 is similar to FIG. 1, with the addition that if the second roll matches the hard point established in the first roll (the come out roll), then the method proceeds to operation 214, wherein the hard pass bet wins and receives an additional bonus payout for achieving this unlikely event. The bonus can be called a "right back" bonus.

If after the second roll, the shooter does not make the hard point (and does not roll a seven), then the method proceeds to a block of operations 216-222, which continues the method with no special bonus if the player then wins the hard pass wager (although of course the player is still able to win the hard pass wager if he can make the hard point before rolling a seven or the point the "easy way.") The payout on the hard pass wager would be lower in operation 222 than operation 214, since reaching operation 214 has a lesser probability than reaching 222.

The hard pass wager can be paid 80-for-1 on any win, regardless of when it occurred, and has a house advantage of 10.21%. If a right back bonus is awarded, then the same house advantage may be obtained by paying a right back win (operation 214) bonus of 225-for-1, as well as subsequent win amounts of 25-for-1 (if the player wins the hard pass bet but not the right back bonus {operation 222}). In other words, instead of paying a fixed amount 80-for-1 for any win, the win amount varies based on when the win occurred—one amount if on the first roll after establishing a point, or another amount anytime thereafter. Table II lists several payout schemes and their house advantages:

TABLE II

| Win on first roll after come-out pays | Win on any other roll pays | House advantage |
|---|---|---|
| 225-for-1 | 25-for-1 | 10.21% |
| 225-to-1 | 25-to-1 | 9.09% |
| 150-for-1 | 50-for-1 | 13.02% |
| 150-to-1 | 50-to-1 | 11.9% |
| 200-for-1 | 40-for-1 | 5.7% |
| 250-for-1 | 15-for-1 | 10.6% |
| 250-for-1 | 20-for-1 | 6.6% |
| 250-for-1 | 25-for-1 | 2.5% |
| 250-to-1 | 25-to-1 | 1.38% |
| 175-for-1 | 50-for-1 | 5.3% |

In Table II, the player has a chance of winning over 100× their initial wager if the bet is won on the next roll (the right back bonus), and this possibility will dramatically raise the level of excitement around the craps table. In fact, this high-payout possibility will occur roughly four times per hour on an average craps table, undoubtedly causing a rush of excitement, and the high payout will actually happen about once every nine hours. This rate is much higher than comparable high-payout craps wagers, and should serve to increase player excitement significantly.

In another embodiment, the original passline wager in casino craps may be enhanced with a pass right back bonus analogous to the right back bonus. If a player establishes a point on the come-out roll and wins on the very next roll (regardless of whether the rolls are hard or easy), the player may be paid 6-5 on his wager instead of the usual 1-1 and earn a pass right back bonus. A 6-5 payout on a pass bonus win yields a 0.13% casino disadvantage, but it may be an effective promotional offering. An 11-10 payout instead yields a 0.64% casino advantage, compared to the normal advantage of 1.41%, and this may be suitable for permanent, non-promotional play.

Thus for example, a shooter bets $100 on the pass line (and the pass right back bonus is offered by the house and pays 11:10 {this can alternatively be viewed as the pass wager pays 1:1 and the pass right back bonus pays 1:10). The shooter rolls a 3/5 on the come out roll (a point of 8). The shooter then immediately thereafter rolls a 2/6. The shooter wins the pass wager (because he made the point before rolling a 7). The shooter also wins the right back bonus because he made the point immediately. The shooter would win $100 for his pass line bet (as known in the standard game of craps) and the player would also win $10 for the pass right back bonus.

As another example: A shooter bets $10 on the pass line. The shooter rolls a 3/5 on the come out roll. The shooter immediately thereafter rolls a 2/4. The shooter then immediately rolls thereafter a 4/4. The shooter has won the pass line wager (wins $10) but does not win the pass right back bonus because he did not make the point immediately (on the second roll).

The pass bonus can also be offered which requires both the come out roll and the matching subsequent matching roll to be hard (a "hard pass right back bonus"). Of course, the probability of this happening is less than if there was no regard given to whether the rolls are hard or not. This wager should be distinguished from the embodiment described in FIG. 2, which details a separate hard pass wager that features the right back bonus. Instead, the "hard pass right back bonus" mentioned in this paragraph is a bonus payout added to the existing pass line wager, without requiring an additional wager to be made.

An example of the embodiment in the immediately preceding paragraph is as follows. A house offers a hard pass right back bonus of 2:10. A shooter wagers $100 on the hard pass right back bonus. The shooter rolls a 3/5 on the come out roll. The shooter cannot win hard pass right back bonus (because the come out roll is not hard), but he can still win his pass wager. As a further example, a shooter wagers $200 on the hard pass right back bonus. The shooter rolls a 4/4 on the come out roll. The shooter then subsequently rolls a 3/5. The shooter wins the pass wager but not the hard pass right back bonus (because the second roll was not hard). As a further example, a shooter wagers $300 on the pass line and rolls a 5/5 on the come out roll. The shooter then subsequently rolls a 5/5. The shooter wins the pass wager and also the hard pass right back bonus. If the hard pass right back bonus pays 2:10, then the shooter would have won $360 ($300 on the pass wager and $60 for the hard pass right back bonus).

Note that the right back bonus is not a new or separate wager, but is a method of modifying any non-single-roll wager to pay a bonused amount if it is won on the first possible roll. For most bets, this will be the first roll after it's made. For the pass line type bets, a shooter has to first do the come-out roll to establish the point and on the next (second) roll the right back bonus can be won. The right back bonus can also be considered an immediate win bonus.

In a further embodiment, a bettor may make a side wager that the shooter will make the point on the roll immediately after the come out roll. If the shooter makes the point on the roll immediately after the come out roll, the side wager would win. Otherwise, depending on the embodiment, the side wager could either: 1) lose, or 2) pay off if the shooter eventually makes the point, albeit at a lower multiplier than if the shooter made the point on the roll immediately after the come out roll. This wager can be considered similar to the hard right back bonus, but what is required is just making the point without regard for whether the rolls are hard or easy.

The right back (or immediate win) bonus can be applied to any wager which allows for more than one random outcome generation, wherein further outcomes are continuously generated until a termination condition (or conditions) occur during the random outcome generation. Random outcomes can be generated using dice, cards, random numbers, or any other indicia than is determined randomly.

For example, consider the "hard 4" wager on craps. This is a standard craps wager that wins if the shooter rolls a hard 4 before rolling a 7 or an "easy 4" (3/1 or 1/3). If the hard 4 wager is made, and then the shooter rolls a hard 4 on the immediate roll after the wager is made, the hard 4 wager wins. If the hard 4 wager is made, and the shooter rolls anything other than a 7 or 4 (e.g. the shooter rolls a 12), then the wager is still live (but is not taken or paid), and upon the next roll if the shooter rolls a 3/1 (easy 4), then the wager loses (because the shooter did not roll a hard 4 before rolling an easy 4 or 7—instead the shooter rolled the hard number (4) the easy way (3/1).

If a player makes a hard 4 wager (or hard any number), then if the immediate roll subsequent to the wager being placed is a hard 4, the player can be entitled to a right back (or immediate win) bonus. If that roll is not a hard 4 (or an easy 4 or 7), and then the next roll is a hard 4, the player would still win the hard 4 wager, but he or she would not win the right back (or immediate win) bonus because the winning roll did not occur on the first possible try.

The hard 4 bet has a standard payout of 8 for 1 on a standard craps game. If the right back (or immediate win) bonus is offered, if the player wins the hard 4 wager and also earns the right back (or immediate win) bonus, then the payout can be pay 10 for 1. If the player doesn't earn the right back bonus but still wins the hard 4 wager then the player can still win the standard 8 for 1 payout. The house edge on the standard hard 4 wager is 11.11%, while the house edge on the hard 4 wager with the 10 for 1 payout on the immediate win would be 5.55%. It should be noted that most wagers in craps, including the hard 4 wager, can be made and subsequently removed prior to winning or losing, regardless of the number of rolls made. For the hard 4 wager, allowing a player to make a wager paying 10 for 1 and removing it if unresolved after the first roll would be advantageous to the player, which is not generally desirable. In this case, it can be a requirement for the hard 4 bet to remain until resolved as either a win or a loss (known as a "contract" bet) in order to qualify for the right back (or immediate win) bonus. This contract bet requirement can also be enforced generally for any wager modified with the right back (or immediate win) bonus, as it ensures that a player will not remove a given wager after the more-favorable first opportunity to win. It is noted that this contract bet requirement already exists for the standard pass and come wagers.

Figure 3:
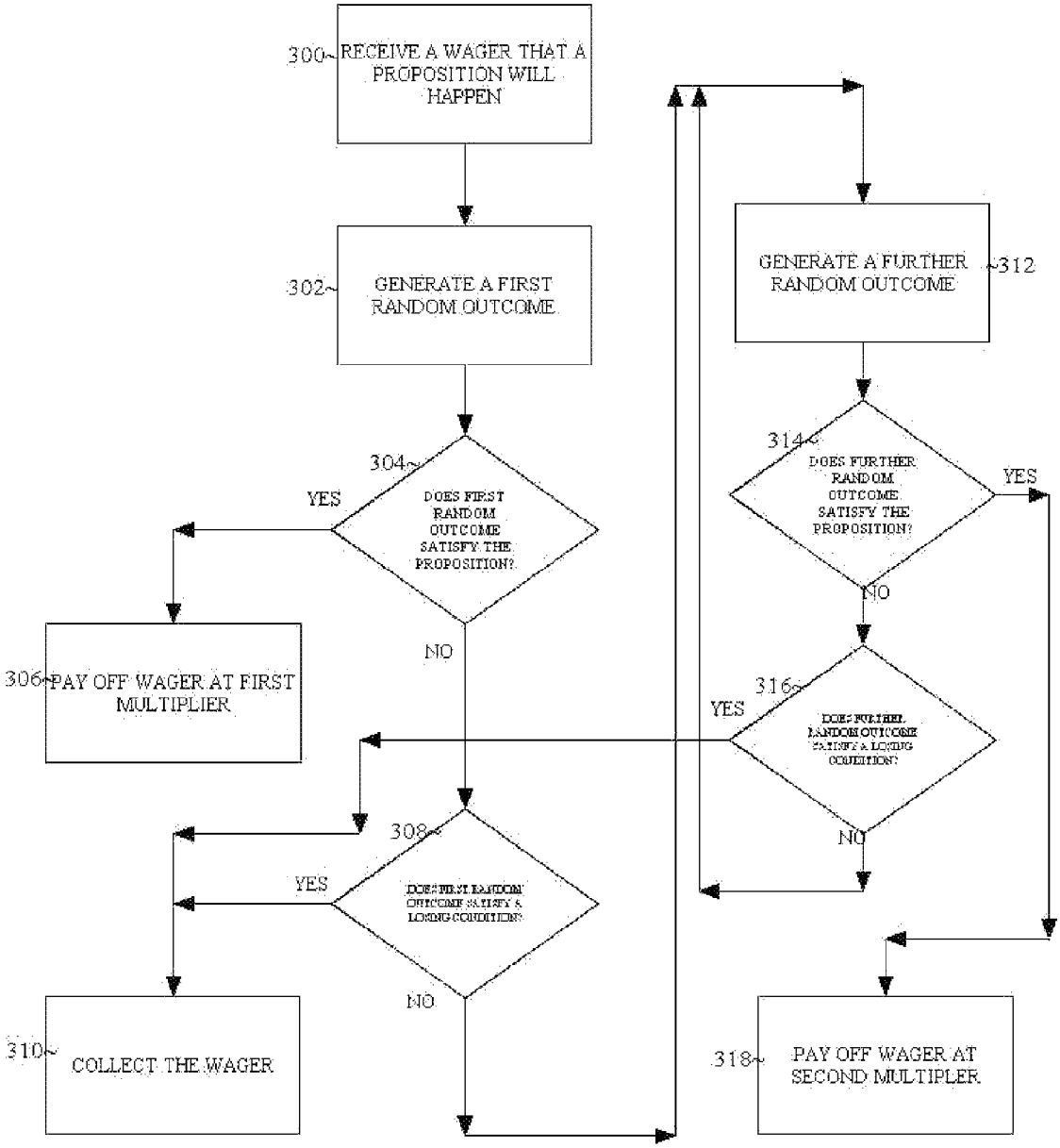
FIG. 3 is a flowchart illustrating an exemplary method of applying an immediate win bonus to a wager, according to an embodiment.

FIG. 3 is a flowchart illustrating an exemplary method of applying an immediate win bonus to a wager, according to an embodiment.

The method can begin with operation 300, which receives a wager that a proposition will happen. For example, the proposition can be one of the following: hard 4, hard 6, hard 8, hard 10, or any other roll of dice (or a die) or hand generated from cards. For example, a wager can be received (typically by the house) by a bettor placing a chip on a craps table on a betting area that says "hard 4."

From operation 300, the method can proceed to operation 302, which generates a first outcome. This can be done, for example, by rolling a pair of dice.

From operation 302, the method can proceed to operation 304, which determines whether the first outcome satisfies the proposition. For example, if the proposition bet on was rolling a hard 4, and the roll in operation 302 was a hard 4 (but not an easy 4 or other roll) then the method can proceed to operation 306, which pays off the wager at a first multiplier. The wager has won and has also earned an immediate bonus because the wager was won immediately.

If the determination in operation 304 determines that the first random outcome did not satisfy the proposition (did not win), then the method proceeds to operation 308, which determines if the first random outcome satisfies a losing condition (loses the wager). For example, a losing condition can be that the shooter rolls a 7 (e.g. the wager loses of the shooter rolls a 7). The losing condition can also be that either the shooter rolls a 7 or rolls an easy 4 (3/1 or 1/3), thus any of these losing rolls will lose the wager for the player. If the determination in operation 304 determines that the losing condition is satisfied, then the method proceeds to operation 310 which collects the wager by the house (the player has lost the wager).

If the determination in operation 308 determines that the first random outcome did not satisfy the losing condition, then the method can proceed to operation 312 (the player has not won/lost yet and needs to keep rolling), which receives a further random outcome. This can be done using a method similar to operation 302.

From operation 312, the method can proceed to operation 314, which determines whether the further random outcome (the most recent further outcome generated) satisfies the proposition. If the outcome satisfies the proposition (e.g. the winning proposition is a hard 4 and the further random outcome is a hard 4), then the method proceeds to operation 318, which pays off the wager at a second multiplier. The second multiplier would be less than the first multiplier, since the probability of reaching operation 318 is greater than the probability of reaching operation 306.

If the determination in operation 314 determines that the further random outcome (the most recently generated one) did not satisfy the proposition (did not win), then the method can proceed to operation 316, which determines whether the further random outcome (the most recently generated) satisfies a losing condition (or conditions). For example, if a losing condition is rolling a 7, and the last further generated outcome (from operation 312) was a 7, then the losing condition is satisfied. If the losing condition is satisfied, the method proceeds to operation 310, which collects the wager by the house (the wager loses).

If the determination in operation 316 determines that the further random outcome (the most recently generated) did not satisfy a losing condition, then the method returns to operation 312, wherein another further random outcome is generated.

In a further embodiment, a right-back bonus award can be applied to the craps standard Place 5 bet, with the contract bet requirement as described above. Place 5 normally pays 7-5 on a win, which is any 5 before a 7. A right-back winner might pay 8-5 if the 5 shows on the next roll after making the wager. On the next and subsequent rolls, if the 5 shows before a 7 then the bettor can win 7-5. If the 7 shows first, then the wager loses. In order to track wagers that are right-back eligible, the dealer could use two-sided lammers to indicate the bets that are eligible for the first-roll right-back bonus, and then flip them over after one roll has passed to indicate the wager is "normal" but remains a contract bet. In other words, each bet that is immediately placed can have a lammer associated with it, and if the bet is still live after the first roll (or first opportunity the wager has to earn a bonus right back (or immediate win) payout), then the lammer can be turned over and the wager can be treated as normal (but not subsequently removed until it either wins or loses). Alternatively, should a casino decide to permanently modify the Place 5 bet (or other wagers) with a right back bonus payout and contract bet requirement, it may be sufficient to remove (rather than turn over) the lammer after the first roll or first immediate win opportunity. That is, if the traditional Place 5 wager is no longer available, the reverse side of the lammer would no longer be required to distinguish a right back/contract Place 5 wager from a normal Place 5 wager after the first roll or first immediate win opportunity.

All wagers described herein can be offered at all rolls in a craps game. Markers or lammers can be used to indicate bets and their respective status in order to identify which bets may have which current properties. Alternatively, some or all wagers can be offered at certain points in a craps game (e.g. only immediately after the come out roll). Alternatively, wagers could be offered depending on the point. For example, if the point is 6, the casino could offer a right-back bonus for this round only on a hard 6 wager as well as a place 8 wager (which is usually made as a complementary wager, as are the complementary pairs 5/9 and 4/10). In a combined embodiment, since many craps bettors make several place and hardway wagers immediately following a comeout roll which establishes a point, place bet wagers may be modified to include a suitable right-back bonus award on the first roll after the comeout roll only, as well as the hardway bet corresponding to the point number (if the point is even), and all these wagers would be made as contract bets and visually indicated as such via lammers or other techniques (such as chip placement) as is known in the art.

Figure 4:
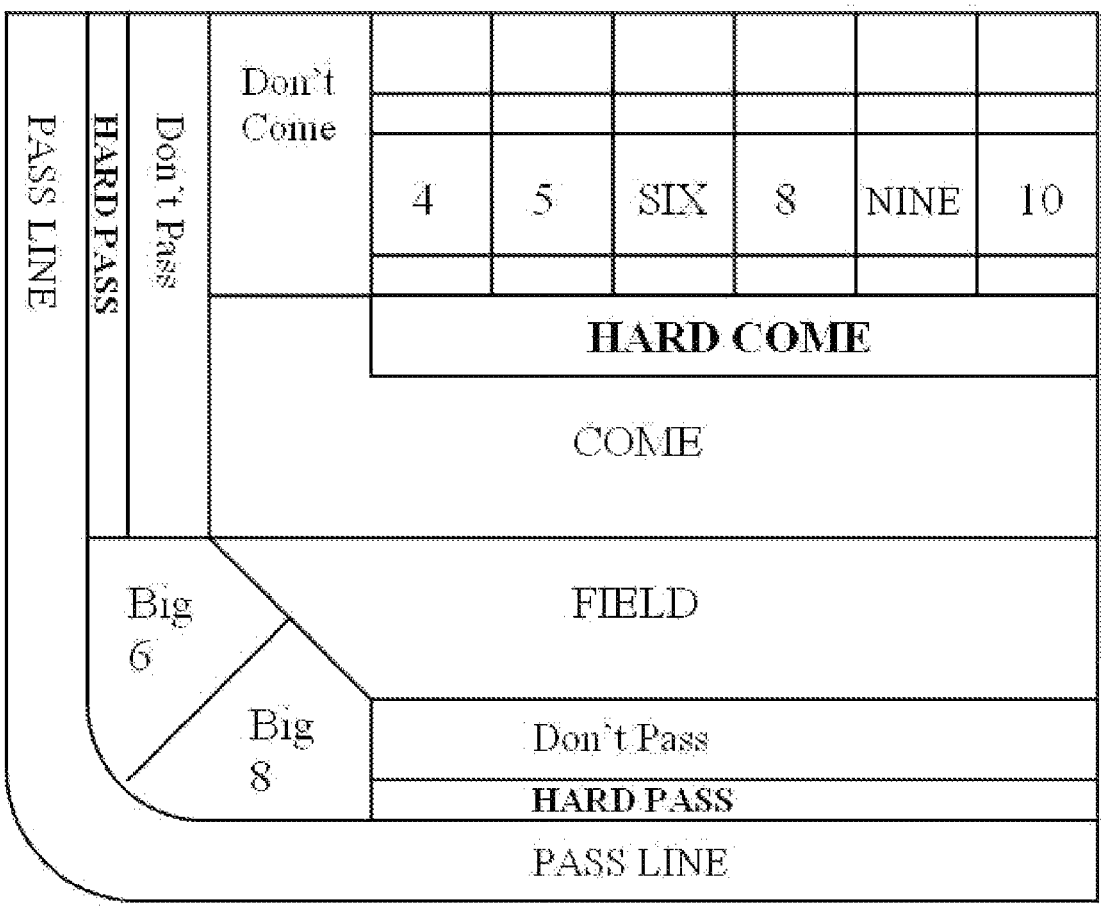
FIG. 4 is an exemplary table layout for a craps game with additional non-standard wagers, according to an embodiment.

FIG. 4 is an exemplary table layout for a craps game with additional non-standard wagers, according to an embodiment.

Note a "hard pass" area and a "hard come" area. These are betting areas where players can place hard pass wagers and hard come wagers, as described herein. The hard come wager is similar to the hard pass but can be placed before any roll (not just before the come out roll) and the next roll will be considered the come out roll for purposes of resolving the hard come wager. Of course, the illustrated layout is merely one example, and other layouts can be used as well which have additional betting area(s) for any of the wagers described herein.

In an alternative layout embodiment, the wagering area for the Hard Pass bet may be placed in the center proposition-bet area rather than adjacent to the Pass Line. Additionally, the hard Pass or hard Come wagering areas may be placed anywhere on the layout as specified by a particular casino based on desired take/pay/place procedures.

Further, the order of any of the operations described herein can be performed in any order and wagers can be placed/resolved in any order. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to receive a hard pass wager on a craps game offered by a house, the method comprising:

receiving a hard pass wager on a craps game;

allowing a shooter to initially roll a pair of dice resulting in a come out roll;

determining if the come out roll is a hard point number, and if not, collecting the hard pass wager and ending the method;

continuing to receive rolls by the shooter until the shooter rolls a last roll having a numeric total in the set consisting of 7 and a numeric total of the come out roll;

determining if the last roll is hard and has a numeric total equaling the numeric total of the come out roll, and if so, paying a first amount based on the hard pass wager and ending the method; and in all other cases, collecting the hard pass wager and ending the method.

2. The method as recited in claim 1, wherein the first amount is a payout of between 75:1 and 85:1.

3. The method as recited in claim 1, further comprising:

determining if the last roll is hard and has a numeric total equaling the numeric total of the come out roll and is a first roll immediately succeeding the come out roll, and if so, paying a second amount greater than the first amount, based on the hard pass wager and ending the method.

4. The method as recited in claim 1, wherein the hard pass wager can be placed before any roll of the dice in a craps game.

* * * * *